United States Patent [19]

Garay et al.

[11] Patent Number: 4,494,122

[45] Date of Patent: Jan. 15, 1985

[54] ANTENNA APPARATUS CAPABLE OF RESONATING AT TWO DIFFERENT FREQUENCIES

[75] Inventors: Oscar M. Garay, N. Lauderdale; Quirino Balzano, Plantation, both of Fla.

[73] Assignee: Motorola, Inc., Schaumburg, Ill.

[21] Appl. No.: 452,166

[22] Filed: Dec. 22, 1982

[51] Int. Cl.[3] ..... H01Q 9/16

[52] U.S. Cl. ..... 343/722; 343/749; 343/792

[58] Field of Search ..... 343/722, 749–752, 343/747, 790–792, 802, 895

[56] References Cited

U.S. PATENT DOCUMENTS

| | | | |
|---|---|---|---|
| 2,184,729 | 12/1939 | Bailey | 343/830 |
| 2,311,472 | 2/1943 | Roosenstein | 343/791 |
| 2,492,404 | 12/1949 | Streib et al. | 343/791 |
| 2,615,131 | 10/1952 | Lindenblad | 343/790 |
| 2,648,771 | 8/1953 | Cork | 343/749 |
| 2,821,709 | 2/1958 | Fucci | 343/790 |
| 2,826,756 | 3/1958 | Cary | 343/703 |
| 2,875,443 | 2/1959 | Kandoian | 343/895 |
| 2,898,590 | 8/1959 | Pichitino | 343/749 |
| 3,048,845 | 8/1962 | Becker | 343/790 |
| 3,541,567 | 11/1970 | Francis et al. | 343/873 |
| 3,689,928 | 9/1972 | Felsenheld | 343/749 |
| 3,902,178 | 8/1975 | Majkrzak | 343/895 |
| 3,932,873 | 1/1976 | Garcia | 343/792 |
| 4,008,479 | 2/1977 | Smith | 343/895 |
| 4,097,867 | 6/1978 | Erocig | 343/895 |
| 4,137,534 | 1/1979 | Goodnight | 343/895 |
| 4,204,212 | 5/1980 | Sindoris et al. | 343/895 |
| 4,229,743 | 10/1980 | Vo et al. | 343/749 |
| 4,425,565 | 1/1984 | Johns | 343/722 |
| 4,442,438 | 4/1984 | Siwiak et al. | 343/792 |

*Primary Examiner*—Eli Lieberman
*Assistant Examiner*—Michael C. Wimer
*Attorney, Agent, or Firm*—Joseph T. Downey; James W. Gillman; Edward M. Roney

[57] ABSTRACT

An antenna is provided which exhibits an overall shortened length with respect to the length of the conventional sleeve dipole type antenna. The antenna includes an upper radiating element coupled to a tank circuit to induce resonance at a first resonant frequency and further includes a helical element electrically coupled to a sleeve member which cooperate to resonate at a second resonant frequency.

5 Claims, 7 Drawing Figures

Fig. 1a
PRIOR ART
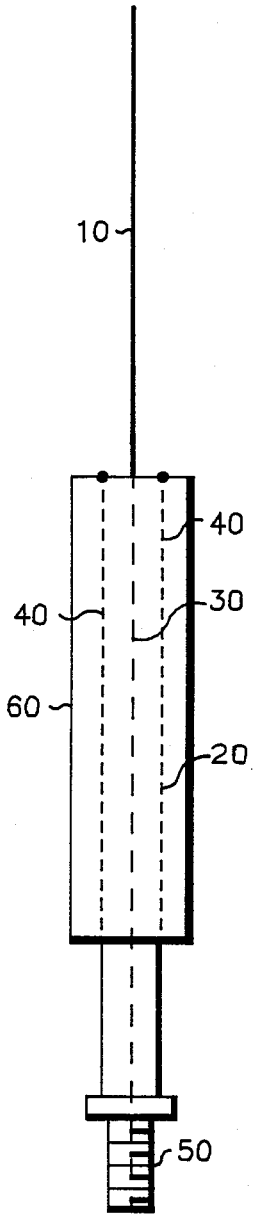
Fig. 1b
PRIOR ART
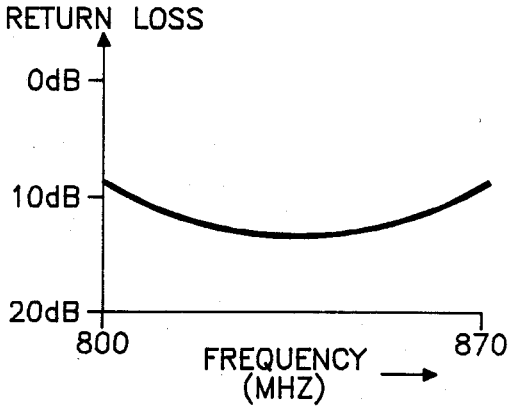
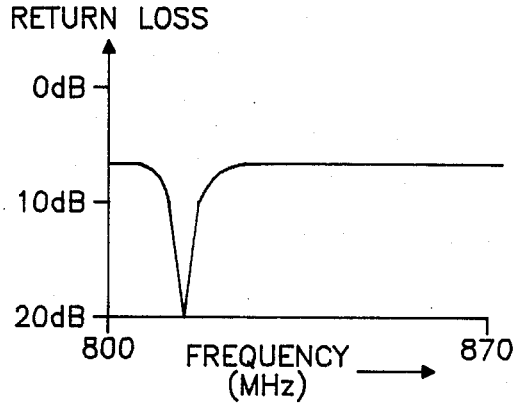
PRIOR ART
Fig. 2b
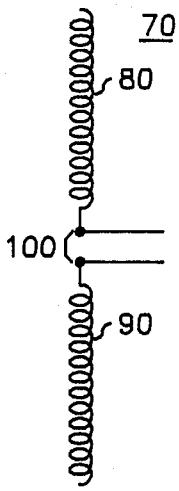
Fig. 2a
PRIOR ART Fig. 3
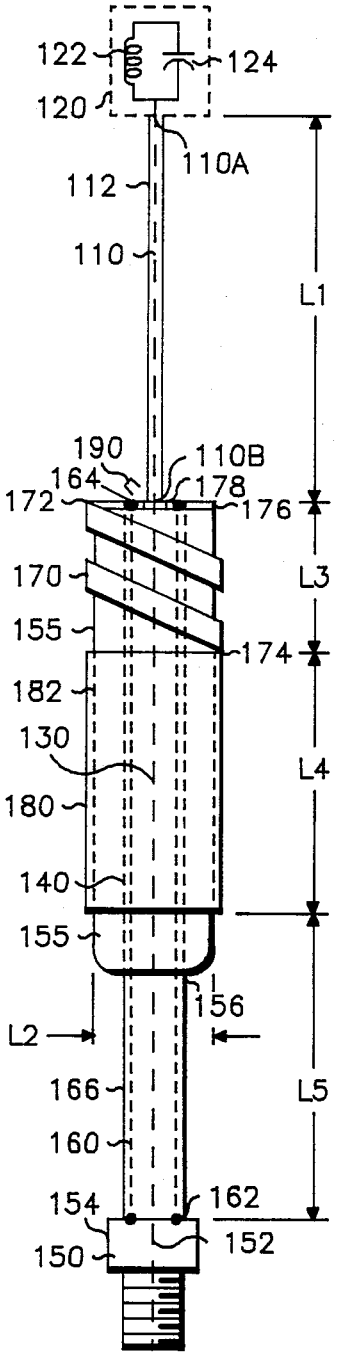
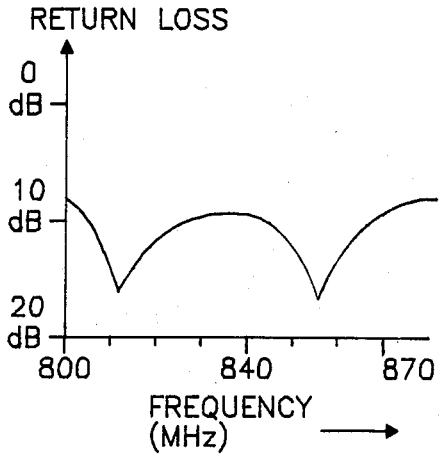
Fig. 4
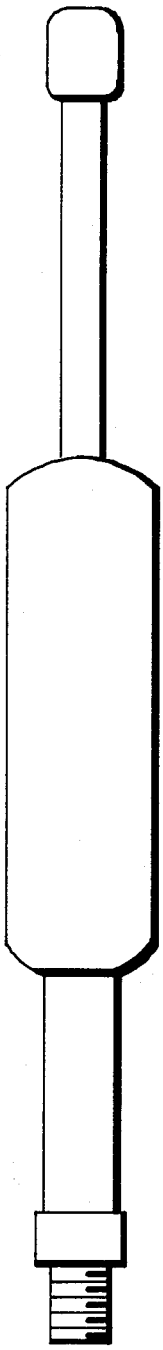
Fig. 5

ANTENNA APPARATUS CAPABLE OF RESONATING AT TWO DIFFERENT FREQUENCIES

BACKGROUND OF THE INVENTION

This invention relates to antenna structures and more particularly to antenna structures capable of resonating at two different frequencies.

DESCRIPTION OF THE PRIOR ART

In the past, large antennas such as half-wave dipoles were quite acceptable as antennas for low frequency fixed station transceivers. Unfortunately, with the advent of portable transceivers operating at relatively high frequencies, such as ultra-high frequency 800 Mhz, the large size of such half-wave dipole antennas with respect to the relatively small size of the portable transceiver makes such dipole antennas impractically large for employment on such transceivers. However, if a full size half-wave dipole could be employed with such a small ultra-high frequency portable transceivers, it would have the advantage of a relatively large impedance bandwidth. Unfortunately, the size of such an antenna is simply too large to be aesthetically acceptable with respect to the modern relatively small portable transceivers on which it would be situated.

One example of the antenna size problem referred to above is the sleeve dipole antenna shown in FIG. 1A which exhibits an overall length of approximately 190 mm at an operating frequency of 800 MHz. The sleeve dipole antenna includes a radiating element 10 exhibiting a length approximately equal to $\frac{1}{4}$ wavelength at the desired operating frequency. The sleeve dipole antenna includes a length of coaxial transmission line 20 having a center conductor 30 and a ground conductor 40. One end of radiating element 10 is electrically coupled to center conductor 30. An appropriate radio frequency coaxial connector 50 is coupled to center conductor 30 and ground conductor 40 such that radio frequency energy supplied to connector 50 is applied to radiating element 10. A cylindrically shaped sleeve 60 of electrically conductive material is situated encompassing coaxial line 20 between radiating element 10 and connector 50. Sleeve 60 exhibits a physical length of approximately $\frac{1}{4}$ wavelength at the desired operating frequency such that the overall length of the sleeve dipole antenna of FIG. 1A is approximately $\frac{1}{2}$ wavelength. As seen in the return loss vs. frequency graph of FIG. 1B, the sleeve dipole antenna of FIG. 1A exhibits a relatively large impedance bandwidth which is typical of coaxially fed, full size half-wave dipole antenna.

One antenna which addresses the length problems exhibited by the aforementioned full size halfwave dipole antenna is shown in FIG. 2A as dual helix antanna 70. Antenna 70 includes helices 80 and 90, each having an adjacent end electrically coupled to a common feedport 100. Helices 80 and 90 are substantially physically shorter in length than radiating 10 and sleeve 40, respectively of the antenna of FIG. 1A. However, due to their respective geometries, helices 80 and 90 exhibit an effective electrical length of $\frac{1}{4}$ wavelength although the actual length of helices 80 and 90 is substantially smaller than a quarter wavelength. It is thus seen that, dual helix antenna 70 has an actual total length of less than one half wavelength. Unfortunately, reducing the length of the dipole antenna in this manner results in a relatively small impedance bandwidth as indicated by the sharp dip in the return loss vs. frequency graph of FIG. 2B. The antenna of FIG. 2A thus satisfactorily functions only over one relatively narrow band of frequencies.

Another antenna which addresses the length problems exhibited by the full size, half-wave dipole antenna of FIG. 1A is described and claimed in the copending U.S. patent application Ser. No. 452,167 entitled Coaxial Dipole Antenna With Extended Effective Aperture, filed Dec. 22, 1982 and assigned to the instant assignee.

It is one object of the present invention to provide an antenna which is capable of operating at more than one resonant frequency.

Another object of the present invention is to provide an antenna which exhibits a substantially shorter length than the standard half-wave dipole antenna.

These and other objects of the invention will become apparent to those skilled in the art upon consideration of the following description of the invention.

BRIEF SUMMARY OF THE INVENTION

The present invention is directed to providing an antenna capable of resonating at two different resonant frequencies.

In accordance with one embodiment of the invention, an antenna exhibiting first and second predetermined resonant frequencies includes a helically configured electrically conductive element having opposed ends. One end of the element is electrically coupled to a feed port. The antenna further includes a first electrically conductive, cylindrically shaped member having opposed ends. One end of such first member is electrically coupled to the remaining end of the first element such that when radio frequency energy is applied to the feed port, the element and the first member cooperate to resonate at a first resonant frequency. The antenna includes a second electrically conductive member having opposed ends. The first and second members and the element are substantially aligned so as to share a common axis between the respective ends thereof. One end of the second member is electrically coupled to the feed port. A resonant circuit is electrically coupled to the remaining end of the second member such that when radio frequency energy is applied to the feed port, the second member and the resonant circuit cooperate to resonate at a second resonant frequency.

The features of the invention believed to be novel are set forth with particularity in the appended claims. The invention itself, however, both as to organization and method of operation, together with further objects and advantages thereof, may best be understood by reference to the following description taken in conjunction with the accompanying drawings.

DESCRIPTION OF THE DRAWINGS

FIG. 1A is a representation of a half-wave sleeve dipole antenna.

FIG. 1B is a return loss vs. frequency graph for the antenna of FIG. 1A.

FIG. 2A is a representation of a dual helix type antenna.

FIG. 2B is a return loss vs. frequency graph of the antenna of FIG. 2A.

FIG. 3 is a representation of one embodiment of the antenna of the present invention.

FIG. 4 is a return loss vs. frequency for the antenna of FIG. 3.

FIG. 5 is a representation of the exterior portions of the antenna of FIG. 3.

DETAILED DESCRIPTION OF THE PREFERRED EMBODIMENT

FIG. 3 illustrates one embodiment of the antenna structure of the present invention. For purposes of discussion, an 800 MHz version of the antenna is described. However, it is understood that the present invention may be employed in other frequency bands of interest by appropriately altering the dimensions and values of components to be discussed henceforth.

The antenna of FIG. 3 includes an element 110 of electrically conductive material situated within a tube 112 of electrically insulative material. Element 110 exhibits a length L1 equal to 42 mm which is selected to cause element 110 to resonate at a frequency between 851 and 860 MHz when one of the opposed ends 110A of element 110 is electrically coupled to tank circuit 120 as shown in FIG. 3. Tank circiuit 120 includes an inductor 122 and a capacitor 124, electrically coupled together in parallel. Capacitor 124 is a low inductance, coaxial type variable capacitor exhibiting a capacitance of 1-10 pF. In this embodiment of the invention, approximately 7 pF is found to be a suitable value for the capacitance of capacitor 124, although it is understood that some variation in this value will occur according to the specific application of the antenna of the invention. Inductor 122 is fabricated by winding approximately 1 and $\frac{3}{4}$ turns of No. 22 wire on a 7 mm diameter coil form. Capacitor 124 is conveniently selected to provide a 7 mm diameter coil form upon which inductor 122 is wound in one embodiment of the invention.

The remaining end 110B is electrically coupled to one end of the center conductor 130 of a coaxial cable 140. Coaxial cable 140, for example 50 ohm impedance UG-178 coaxial cable, is the feedline for the antenna of FIG. 3. The remaining end of center conductor 130 is electrically coupled to the center conductor portion 152 of a coaxial connector 150 as seen in FIG. 3. Coaxial cable 140 includes a ground conductor 160 having opposed ends 162 and 164, one end 162 of which is electrically coupled to the ground portion 154 of coaxial connector 150. Coaxial cable 140 includes an electrically insulative covering 166.

A substantially cylindrically shaped dielectric spacer 155 is situated to encapsulate a portion of coaxial cable 140 as shown in FIG. 3. Spacer 155 is formed of an electrically insulative material such as Teflon TM. Spacer 155 includes a central aperture 156 situated from end to end thereof and having an inner diameter sufficiently large to accommodate coaxial cable 140 therein. The outer diameter of spacer 155 is 7 mm.

End 164 of coaxial cable ground conductor 160 is electrically coupled to one end 172 of a helix 170 which is concentrically wound around a portion of dielectric spacer 155. Ground conductor end 164 is coupled to helix end 172 via an electrically conductive disc 176 to which ends 164 and 172 are electrically connected. Disc 176 includes an aperture 178 at the center thereof. Aperture 178 exhibits a diameter sufficiently large for insulator tube 112 to pass therethrough to accommodate the connection of element end 110B to coaxial cable center conductor 130.

Helix 170 is formed of 1 and $\frac{3}{4}$ turns of ribbon-like electrically conductive material exhibiting a thickness of 0.5 mm and wound around a portion of dielectric spacer 155 as seen in FIG. 3. Helix 170 exhibits a length L3 equal to 9 mm. Helix 170 is oriented to share a central common axis with coaxial cable 140 as shown in FIG. 3.

Helix end 174 is electrically coupled to one end of an electrically conductive sleeve portion 180 which is fit over a portion of dielectric spacer 155 as seen in FIG. 3. Sleeve portion 180 is comprised of electrically conductive material and exhibits a cylindrical geometry and a wall thickness of 0.5 mm. An aperture 182 extends from end to end of sleeve portion 180. Aperture 182 exhibits a sufficiently large diameter to accommodate dielectric spacer 155 therein. Sleeve portion 180 exhibits a length L4 equal to 27 mm and is oriented to share a central common axis with coaxial cable 140. The distance between coaxial connector 150 and sleeve member 180 is defined to be L5, which in this embodiment of the invention equals 31 mm. Thus, the overall length of the antenna of the present invention is approximately 109 mm exclusive of tank circuit 120.

Helix 170 and sleeve portion 180 cooperate together to resonate at a frequency between approximately 806 and 815 MHz when excited by radio frequency energy supplied via coaxial cable 140 to the feed port 190 formed by element end 110B and ground conductor end 164. More specifically, when feed port 190 is so exciteed with radio frequency energy, the return loss exhibited by the antenna of FIG. 3 drops or dips to usable values at frequencies between approximately 806 and 815 MHz. Usable values of return loss are defined to be values of return loss greater then approximately 10 dB. A dip in return loss which is centered at approximately 810 MHz is observed in the return loss v. frequency graph of the present antenna in FIG. 4. The antenna of FIG. 3 resonates, that is, experiences a return loss dip at a frequency of approximately 810 MHz due to the interaction of helix 170 and sleeve 180 which together exhibit an effective electrical length of one quarter wavelength of such selected operating frequency.

From the above, it is seen that the antenna of FIG. 3 resonates at a frequency between approximately 851 and 860 MHz due to the action of element 110 and tank circuit 120 which together exhibit an effective electrical length of one quarter wavelength of such selected operating frequencies. More specifically, when feed port 190 is excited element 110 and tank circuit 120 cooperate to cause a dip in the return loss of the present antenna to usable values between the frequencies of approximately 851-806 MHz as seen in the return loss v. frequency graph of FIG. 4.

Thus, the antenna of FIG. 3 is suitable for employment in applications, for example, wherein a radio transmits on a first resonant frequency and receives on a second resonant frequency separated therefrom by a substantial amount of bandwidth. In other words, this antenna is optimally employed in the situation wherein the frequency response of the antenna between the aforementioned first and second resonant frequency is not important. The return loss vs. frequency graph of FIG. 4 clearly shows that the antenna of the present invention resonates at approximately 810 MHz and 855 MHz whereas response between these two resonant frequencies is somewhat attenuated. Thus, as stated, the antenna is most advantageously employed in circumstances where maximal response at the first and second resonant frequencies is important and the response between such frequencies is of little consequence.

FIG. 5 represents the outer appearance of the antenna of FIG. 3 after such antenna is coated with a plastic or other protective material to protect such antenna from the elements and to give the antenna structural integrity.

The foregoing describes an antenna structure which exhibits an overall length substantially reduced as compared to a half-wave sleeve dipole type antenna. Such antenna is capable of resonating at two resonant frequencies within a desired band.

While only certain preferred features of the invention have been shown by way of illustration many modifications and changes will occur to those skilled in the art. It is, therefore, to be understood that the present claims are intended to cover all such modifications and changes as fall within the true spirit of the invention.

What is claimed is:

1. An antenna exhibiting first and second predetermined resonant frequencies comprising:

a helically configured electrically conductive element having opposed ends, one end of said element being electrically coupled to a feed port;

a first electrically conductive, cylindrically shaped member having opposed ends, one end of said member being electrically coupled to the remaining end of said element, such that when radio frequency energy is applied to said feed port, said element and said first member cooperate to resonate at a first frequency;

a second electrically conductive member having opposed ends, one end of said second member being electrically coupled to said feedport;

said first and second members and said element being substantially aligned so as to share a common axis between the respective ends thereof, and resonant circuit means, electrically coupled to the remaining end of said second member, such that when radio frequency energy is applied to said feed port, said second member and said resonant circuit means cooperate to resonate at a second resonant frequency.

2. The antenna of claim 1 including a coaxial feedline having a center conductor and a ground conductor situated within said first member and said element, said center conductor being electrically coupled to the end of said second member which is coupled to said feed port, said ground conductor being electrically coupled to the end of said element which is coupled to said feed port.

3. The antenna of claim 1 wherein said resonant circuit means comprises a tank circuit including a capacitor and an inductor electrically coupled together in parallel.

4. An antenna exhibiting dips in return loss at first and second predetermined frequencies comprising:

a helically configured electrically conductive element having opposed ends, one end of said element being electrically coupled to a feed port;

a first electrically conductive, cylindrically shaped member having opposed ends, one end of said member being electrically coupled to an end of said element, such that when radio frequency energy is applied to said feed port, said element and said first member cooperate to exhibit a dip in return loss at said first frequency at said feed port;

a second electrically conductive member having opposed ends, one end of said second member being electrically coupled to said feed port; said first and second members and said element being substantially aligned so as to share a common axis between the respective ends thereof, and resonant circuit means, electrically coupled to the remaining end of said second member, such that when radio frequency energy is applied to said feed port, said second member and said resonant circuit means cooperate to exhibit a dip in return loss at said second frequency at said feed port.

5. The antenna of claim 4 wherein said resonant circuit means comprises a tank circuit including a capacitor and an inductor electrically coupled together in parallel.

* * * * *